US009538817B2

(12) United States Patent
Ogura et al.

(10) Patent No.: US 9,538,817 B2
(45) Date of Patent: Jan. 10, 2017

(54) SEALING FOR OPEN-END SLIDE FASTENER

(71) Applicant: YKK CORPORATION OF AMERICA, Marietta, GA (US)

(72) Inventors: Suguru Ogura, Macon, GA (US); Jesse Bryon Robinson, Macon, GA (US); Wolfgang Coronel, Macon, GA (US)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/337,887

(22) Filed: Jul. 22, 2014

(65) Prior Publication Data

US 2016/0021990 A1 Jan. 28, 2016

(51) Int. Cl.
*A44B 19/32* (2006.01)
*A44B 19/26* (2006.01)

(52) U.S. Cl.
CPC ..... *A44B 19/32* (2013.01); *A44B 19/267* (2013.01); *Y10T 24/2593* (2015.01); *Y10T 24/2595* (2015.01)

(58) Field of Classification Search
CPC . A44B 19/32; A44B 19/3638; Y10T 24/2561; Y10T 24/2593; Y10T 24/2595
USPC ..... 24/387, 389, 415, 433, 434, 436
See application file for complete search history.

(56) References Cited

U.S. PATENT DOCUMENTS 2,928,155 A 3/1960 Kallio
4,112,553 A * 9/1978 Weitzner ..... A44B 19/38 24/433
5,608,952 A 3/1997 Wilder
5,697,130 A 12/1997 Smith
6,481,068 B1 * 11/2002 Takasawa ..... A44B 19/38 24/388
6,502,285 B2 1/2003 Kiely
2007/0074380 A1 * 4/2007 Matsumoto ..... A44B 19/32 24/389
2007/0226965 A1 10/2007 Cossutti
2012/0260470 A1 * 10/2012 Keyaki ..... A44B 19/36 24/433

FOREIGN PATENT DOCUMENTS

CN 101077239 A 11/2007
EP 1481601 5/2008
JP H01-313001 A 12/1989
JP H07-124005 A 5/1995
JP H0759204 6/1995
JP H10-194303 A 7/1998
(Continued)

OTHER PUBLICATIONS

Office Action, Japanese Patent Application No. 2015-137113, mailed May 24, 2016 (3 pages of Japanese Office Action, 4 pages of English translation).

(Continued)

*Primary Examiner* — Robert J Sandy
*Assistant Examiner* — David Upchurch
(74) *Attorney, Agent, or Firm* — Kilpatrick Townsend & Stockton LLP

(57) ABSTRACT

Open-ended slide fasteners that are watertight and/or air-tight. The slide fasteners include box and pin mechanisms integrated with the slide fastener and configured to compress the tape edges and create a water and air tight seal, thus eliminating the need for installing a separate component after the slide fastener has been manufactured.

25 Claims, 9 Drawing Sheets

(56) References Cited

FOREIGN PATENT DOCUMENTS

| | | | |
|---|---|---|---|
| JP | 2005-021667 | A | 1/2005 |
| JP | 2006-296732 | A | 11/2006 |
| TW | I248796 | B | 2/2006 |
| TW | I309157 | B | 5/2009 |

OTHER PUBLICATIONS

Office Action, Taiwanese Patent Application No. 104123740, mailed Jul. 13, 2016 (15 pages of Taiwanese Office Action, 11 pages of English translation).

* cited by examiner

SEALING FOR OPEN-END SLIDE FASTENER

FIELD OF THE INVENTION

Open-end slide fasteners that are watertight and/or airtight.

BACKGROUND

A slide fastener is used to secure two pieces of fabric or other flexible material. A slide fastener includes a slider that engages with elements located on tapes to open and close the slide fastener. When the slider is moved along the tape, a generally Y-shaped channel meshes together rows of opposing elements of the tapes to close the slide fastener. When the slider is moved in the opposite direction, the generally Y-shaped channel separates the rows of opposing elements to open the slide fastener.

An open-ended zipper often includes a box and pin mechanism at one end of the tapes to align the slider properly with respect to the elements of the two tapes so that the slide fastener may open and close properly. The other end of the tapes may include a top stop, which receives the slider when in the closed position and prevents the slider from sliding off the ends of the tapes.

Existing open-end slide fasteners are made water and air tight by adding a separate box component to the tapes and attaching the separate box component using an additional component such as a screw or other mechanical fastener mechanism, as disclosed in EP 1481601 filed Sep. 6, 2004. The separate box component is installed after the slide fastener has been manufactured by a screwing operation that is complex and labor intensive. Moreover, there is a possibility that the separate component can be lost or damaged. When the slide fastener is attached to a garment, the separate component in turn needs to be attached to the garment by caulking or other suitable method, which is also complex and labor intensive.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Disclosed are open-ended slide fasteners that are watertight and/or airtight. The slide fasteners include box and pin mechanisms integrated with the slide fastener and configured to compress the tape edges and create a water and air tight seal, thus eliminating the need for installing a separate component after the slide fastener has been manufactured.

BRIEF DESCRIPTION OF THE DRAWINGS

Illustrative embodiments of the present invention are described in detail below with reference to the following drawing figures.

DETAILED DESCRIPTION

Disclosed are improved open-end slide fasteners that are configured to be water and/or air tight without requiring the installation of additional, separate parts after the tapes have been manufactured. In particular, the disclosed open-end slider fasteners, such as the slide fastener assembly 8 shown in FIG. 1, include integrated top stops and box and pin assemblies that are configured to form a water and/or air tight seal. The disclosed assemblies are particularly well suited for open-end configurations where the tapes are separate from one another when their elements are unengaged and when it is desirable that the assembly form a water and/or air tight seal.

Figure 1:
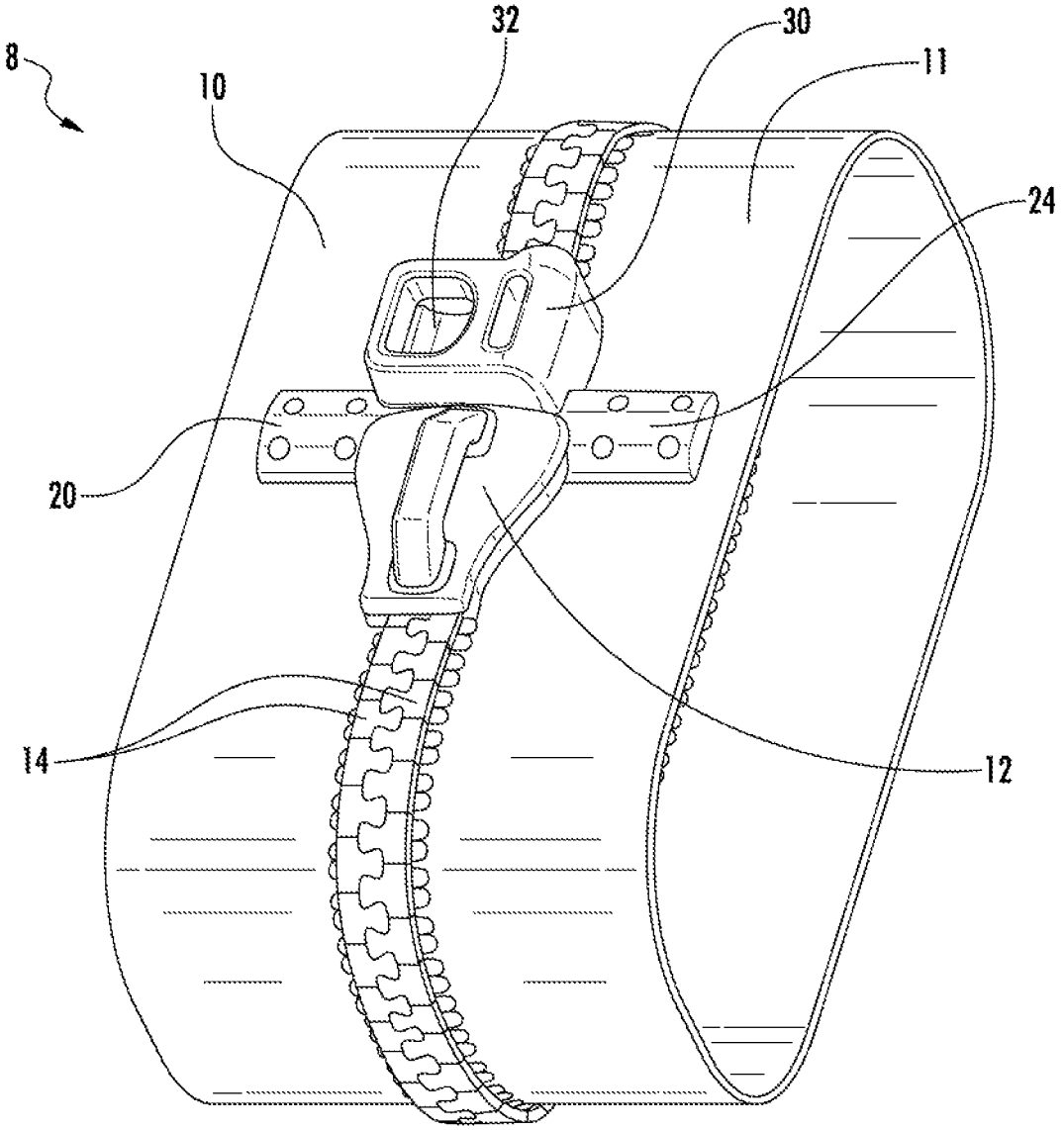
FIG. 1 is a perspective view of a slide fastener according to one embodiment, shown in the closed position.
Figure 2:
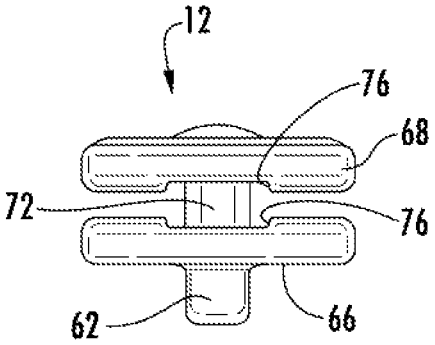
FIG. 2 is a front view of a slider according to one embodiment.
Figure 3:
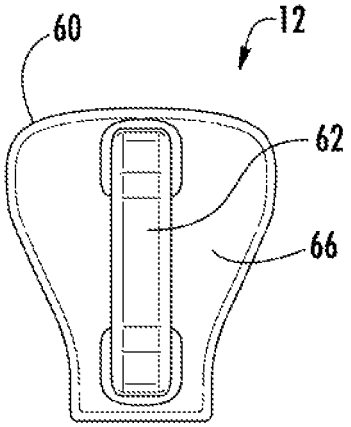
FIG. 3 is a top view of the slider of FIG. 2.
Figure 4:
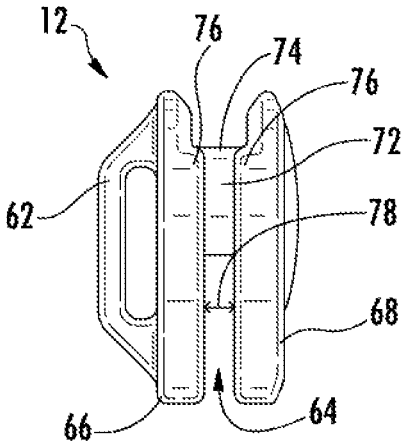
FIG. 4 is a side view of the slider of FIG. 2.
Figure 5:
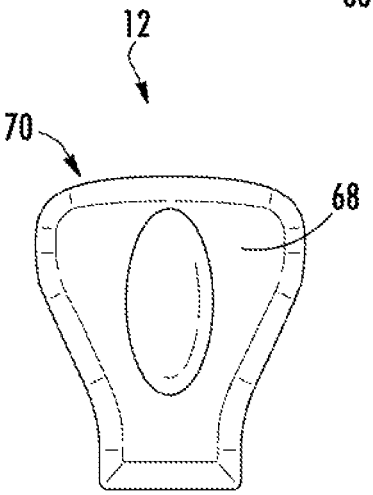
FIG. 5 is a bottom view of the slider of FIG. 2.
Figure 6:
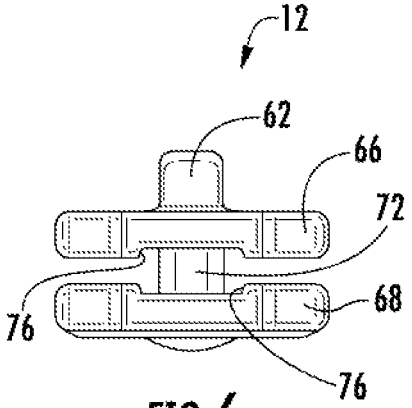
FIG. 6 is a rear view of the slider of FIG. 2.

As shown in FIG. 1, slide fastener assembly 8 includes a first tape 10, which may be attached to a first article, and a second tape 11, which may be attached to a second article or another part of the first article. In some embodiments, the tapes 10, 11 are coated with polyurethane or other suitable material. Because the tapes 10, 11 are separate from one another when their elements are unengaged (i.e., they are part of an open-ended slide fastener), they are particularly well suited for use on articles of clothing that are separate from one another, such as an air and/or water tight suit having a jacket and pants. Some non-limiting applications of the disclosed slide fastener assemblies include kayak suits, rain suits, wet suits, dry suits, emergency suits, etc.

As shown in FIG. 1, the two ends of first tape 10 may join together into a loop and the two ends of second tape 11 may join together into a loop, although they need not. In some embodiments, the two ends of each tape 10, 11 are attached by injection molding that connects the two ends of first tape 10 with a first extension 20 and the two ends of second tape 11 with a second extension 24. When the elements 14 of the two tapes 10, 11 are coupled together (i.e., the slide fastener assembly 8 is in the closed position), the slide fastener assembly 8 may also form a loop, as shown in FIG. 1.

To open and close slide fastener assembly 8, slider 12 cooperates with elements 14 located on first and second tapes 10, 11. Slider 12 typically includes a slider body, such as slider body 60, and a pull tab (not shown) that attaches to the slider body in a known manner. Slider body 60 can be of conventional construction so that the top and bottom wings are generally similar in shape and size, although they need not be. As shown in FIGS. 2-6, slider body 60 includes a top wing 66 and a bottom wing 68 that are spaced apart from one another and joined at the front 70 by a connecting neck 72 (sometimes referred to as a diamond) to form a generally Y-shaped guide channel 64. The connecting neck 72 includes a leading portion 74. Pillar 62, around which a pull tab can be pivot, extends from the top wing 66. When the pull tab is moved in one direction, generally Y-shaped channel 64 meshes together rows of opposing elements of the tapes. When the pull tab is moved in the opposite direction, the generally Y-shaped channel separates the rows of opposing elements.

Figure 8:
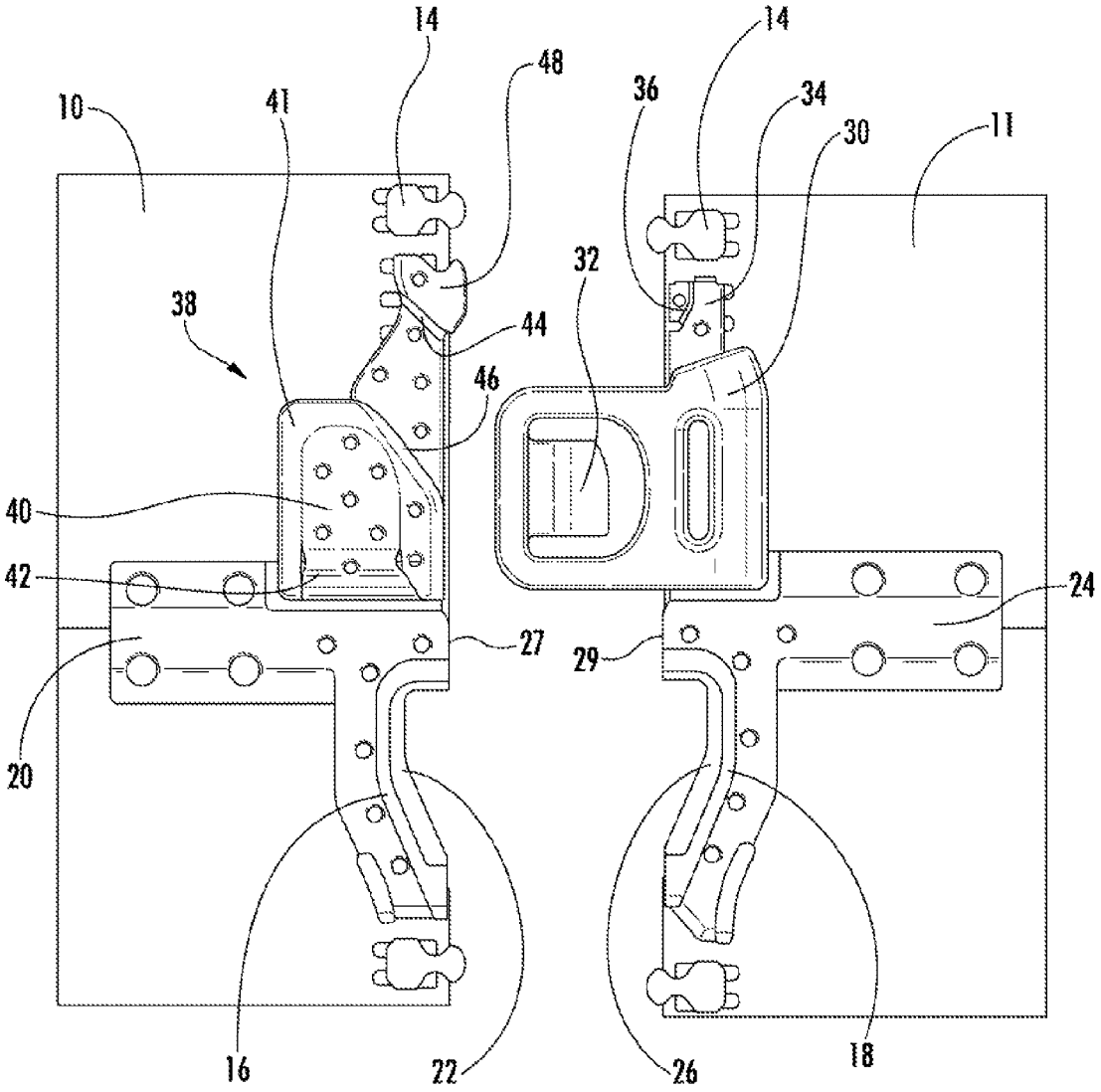
FIG. 8 is a front view of a portion of the slide fastener of FIG. 1, shown in the open position.
Figure 17:
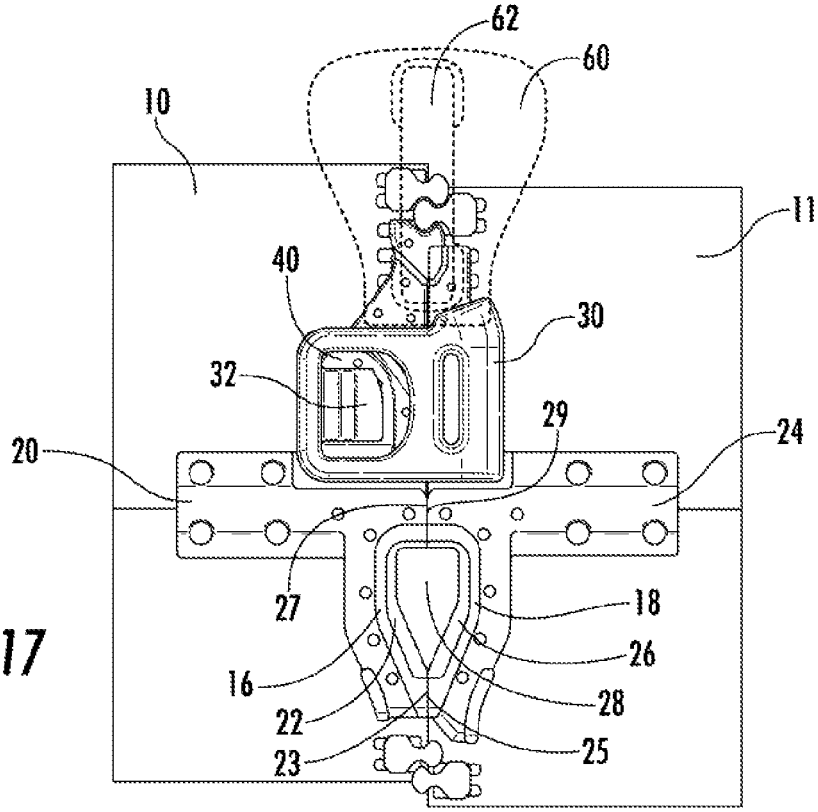
FIG. 17 illustrates the engagement of the pin element of FIG. 14 with the box element of FIG. 11, with the slider at a first end of the tape.
Figure 18:
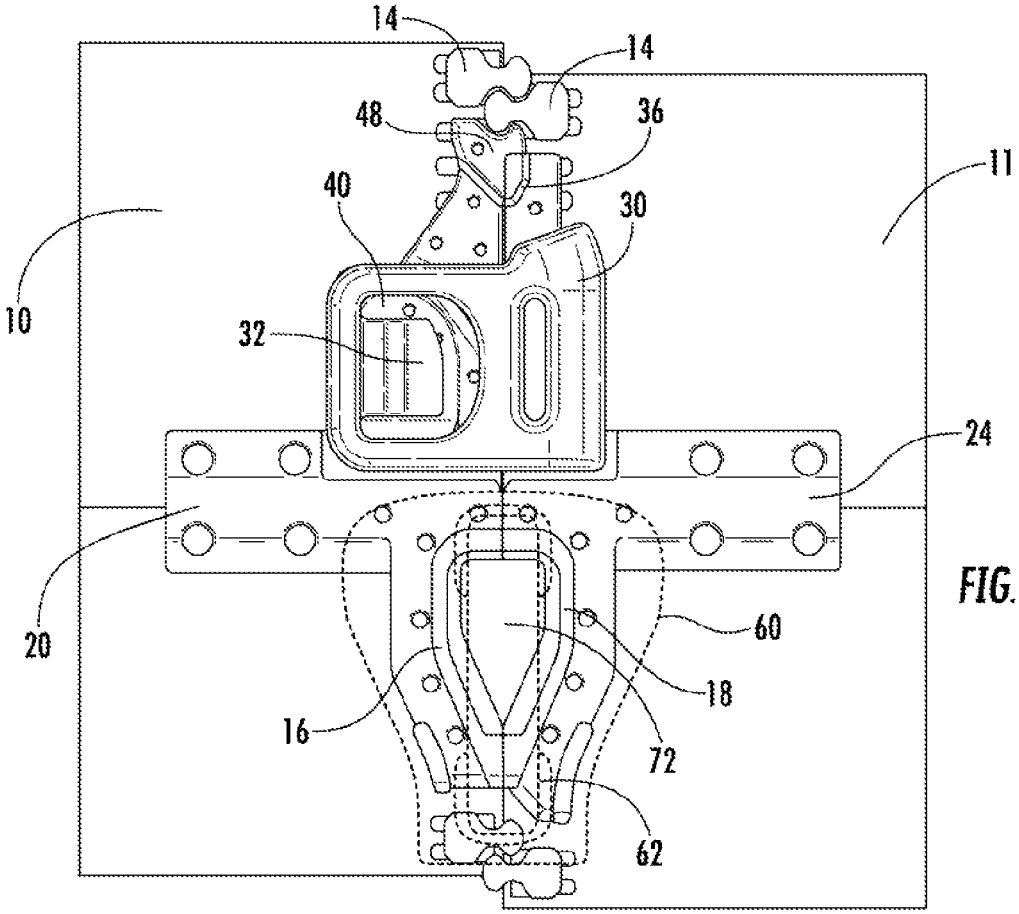
FIG. 18 illustrates the engagement of the pin element of FIG. 14 with the box element of FIG. 11, with the slider at a second end of the tape and received within the top stop.
Figure 19:
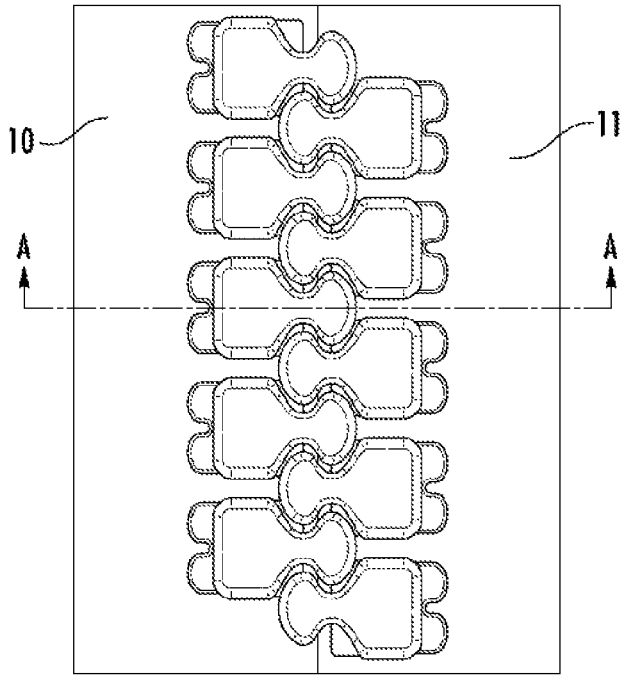
FIG. 19 is a front view of a portion of engaged elements of the slider fastener of FIG. 1.

As shown in FIG. 8, first extension 20 that joins the two ends of first tape 10 may extend laterally from a first top stop 16 associated with first tape 10. Similarly, second extension 24 that joins the two ends of second tape 11 may extend laterally from a second top stop 18 associated with second tape 11. As shown in FIG. 17, when edge 27 of first top stop 16 abuts edge 29 of second top stop 18, first top stop 16 and second top stop 18 form a cavity 28 configured to receive the neck 72 of slider 12. In this way, first top 16 and second top stop 18 cooperate with a slider, such as slider 12 shown in FIGS. 1-6, to limit the traversal of the slider along the tapes 10, 11. In addition, top stops 16, 18 are configured to engage with the slider 12 such that no gaps exist between the top stops 16, 18 and the slider 12 so that water and/or air is prevented from penetrating the slider assembly 8. In particular, the top stops 16, 18 are compressed against each other and with slider 12 to maintain the water and air tight characteristics of the slide fastener assembly 8.

When the tapes 10, 11 are each formed into a loop arrangement (FIG. 1), top stop 16 is positioned with respect to a pin 38 of tape 10 (FIG. 8) and top stop 18 is positioned with respect to a box 30 of tape 11 (FIG. 8). As discussed in more detail below, pin 38 engages with box 30 to align the slider 12 properly with respect to two otherwise-separate tapes 10, 11 so that the slide fastener assembly 8 may open and close properly. Box 30 and pin 38 may be formed of any suitable flexible material, including for example, any suitable polymer like Nylon® or an elastomer such as a thermoplastic elastomer or any other suitable material. In some embodiments, box 30 and pin 38 are formed of the same material as the elements 14 and/or the top stops 16, 18, although they need not be.

Figure 11:
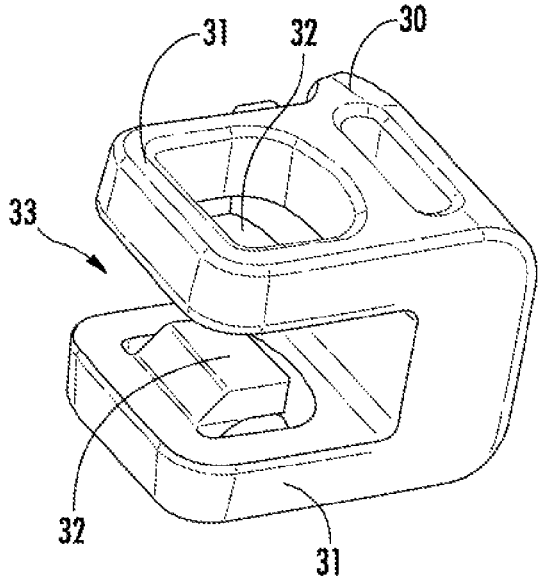
FIGS. 11-12 are perspective views of the box element of the slide fastener of FIG. 1.
Figure 12:
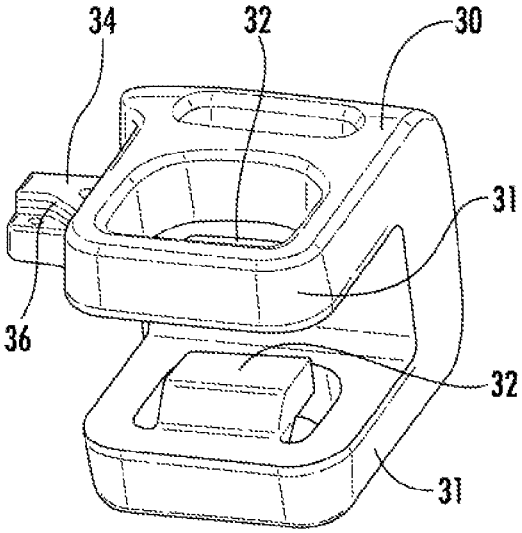
Figure 13:
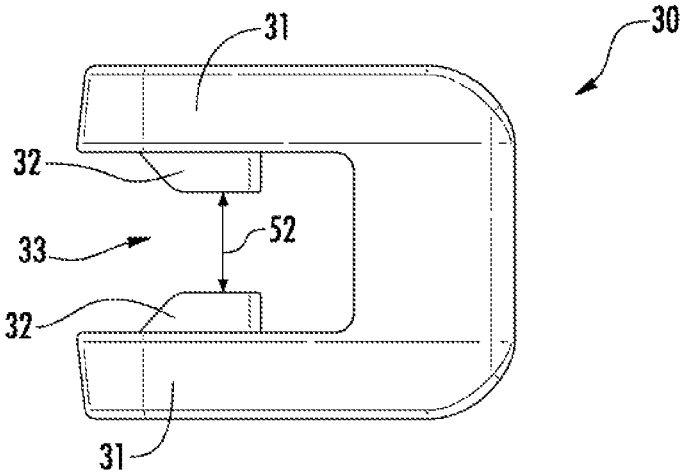
FIG. 13 is a side view of the box element of FIG. 11.
Figure 15A:
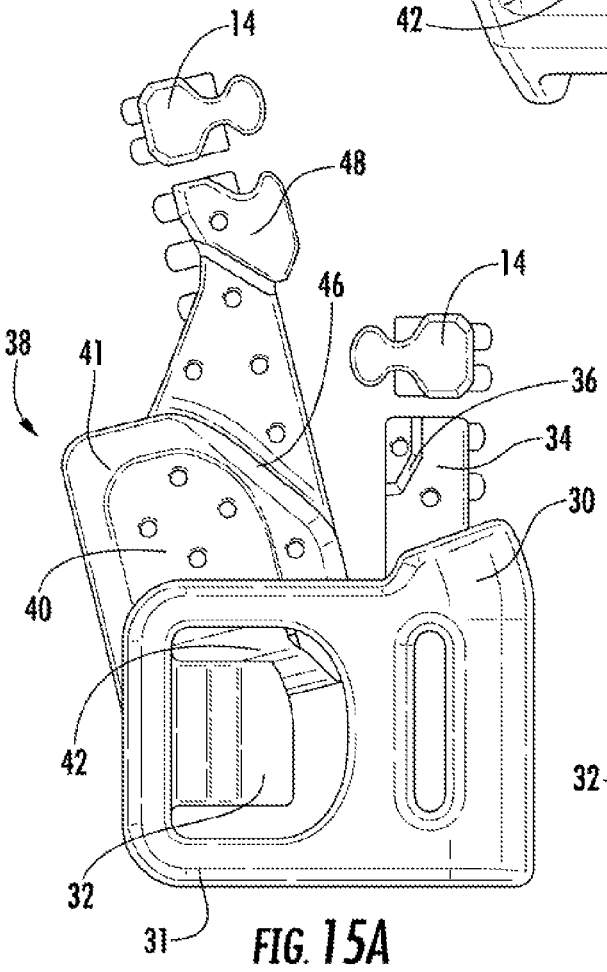
FIG. 15A illustrates the initial engagement of the pin element of FIG. 14 with the box element of FIG. 11, in isolation.

As shown in FIGS. 11-13, box 30 includes two portions 31 associated with opposites sides of second tape 11, where inner surfaces of portions 31 are separated from one another by a cavity 33. In other embodiments, only one portion 31 is present. One or both portions 31 include an arm 32 that projects into the cavity 33. Arm 32 is flexible/deformable to operate similar to a hinge mechanism. Although box 30 is illustrated as having a generally open configuration, with each portion 31 having a cutout, portion 31 could be solid or substantially solid in other embodiments. If two arms 32 are used (as illustrated in the Figures), the arms 32 may be separated from one another by a dimension 52, as shown in FIG. 13. As shown in FIGS. 12 and 15A, a guide element portion 34 extends from box 30, and a plurality of elements are adjacent guide portion 34. Guide element 34 includes a cavity 36, discussed below.

Figure 9:
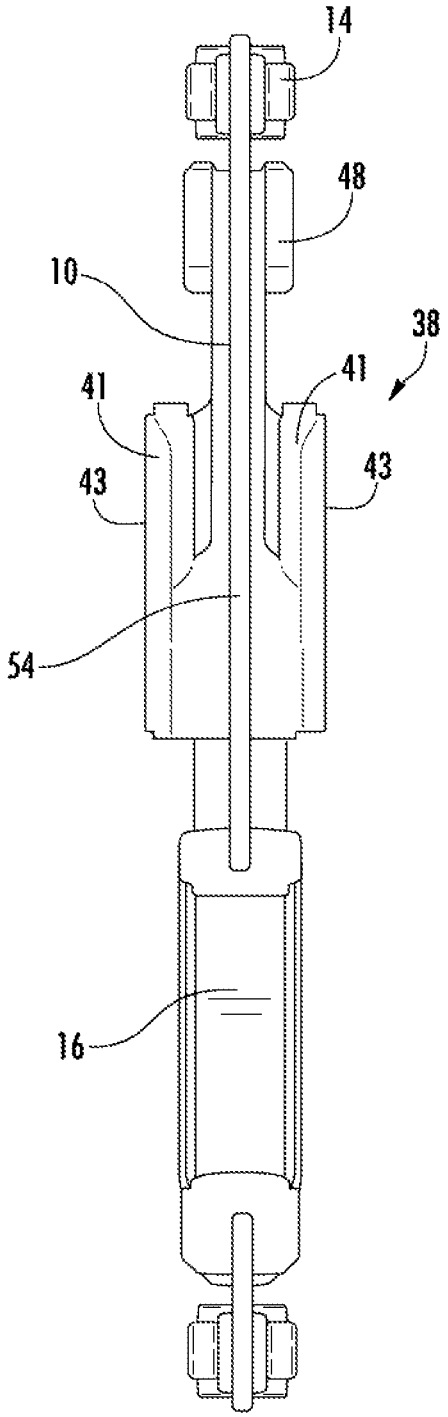
FIG. 9 is a cross-sectional view of a portion of a first of the tapes of the slide fastener of FIG. 1.
Figure 10:
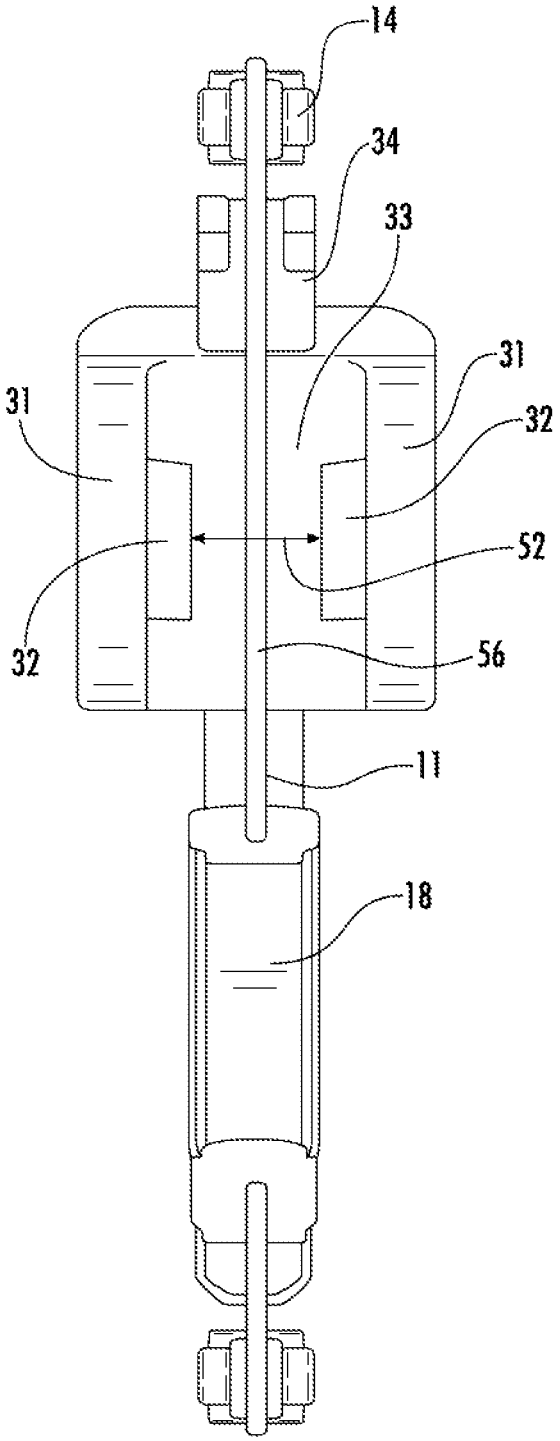
FIG. 10 is a cross-sectional view of a portion of a second of the tapes of the slide fastener of FIG. 1.
Figure 14:
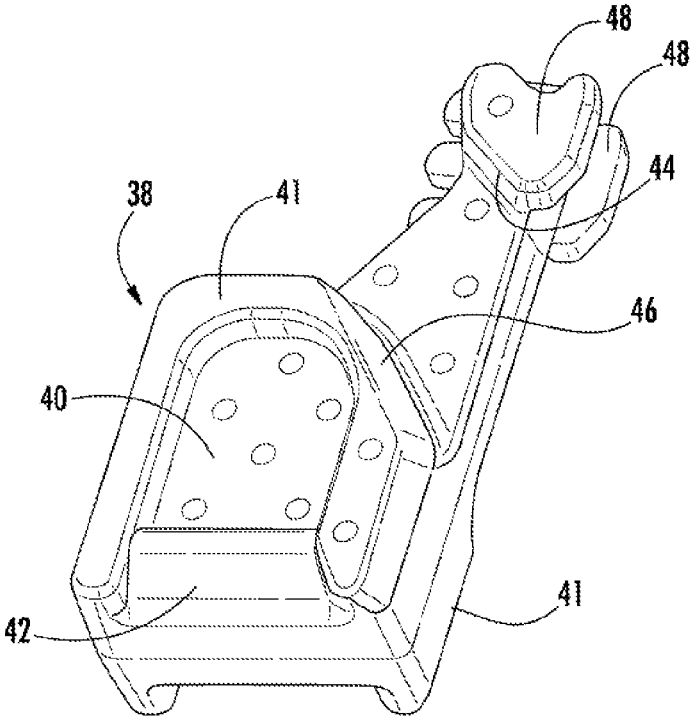
FIG. 14 is a perspective view the pin element of the slide fastener of FIG. 1.

Box 30 is configured to receive a pin 38, which is shown in isolation in FIG. 14, first in an initially engaged position and then in a received position. As shown in FIG. 9, pin 38 includes two portions 41 associated with opposite sides of tape 10, although in other embodiments, only one portion is used. With reference to FIGS. 9 and 14, each of the portions 41 includes an outer surface 43 and an insertion area 40 that is recessed relative to the outer surface 43 of the portion 41. A protrusion 42 projects from a distal end of each of the insertion areas 40. Each of the protrusions 42 that projects from the insertion areas 40 is configured to cooperate with a respective one of the one or more arms 32 of the box 30 as the pin 38 moves from the initially engaged position into the received position. The width between the two protrusions 42 is greater than dimension 52 between inner surfaces of the two arms 32 (FIG. 10). Insertion areas 40 are dimensioned to receive arms 32.

Figure 7:
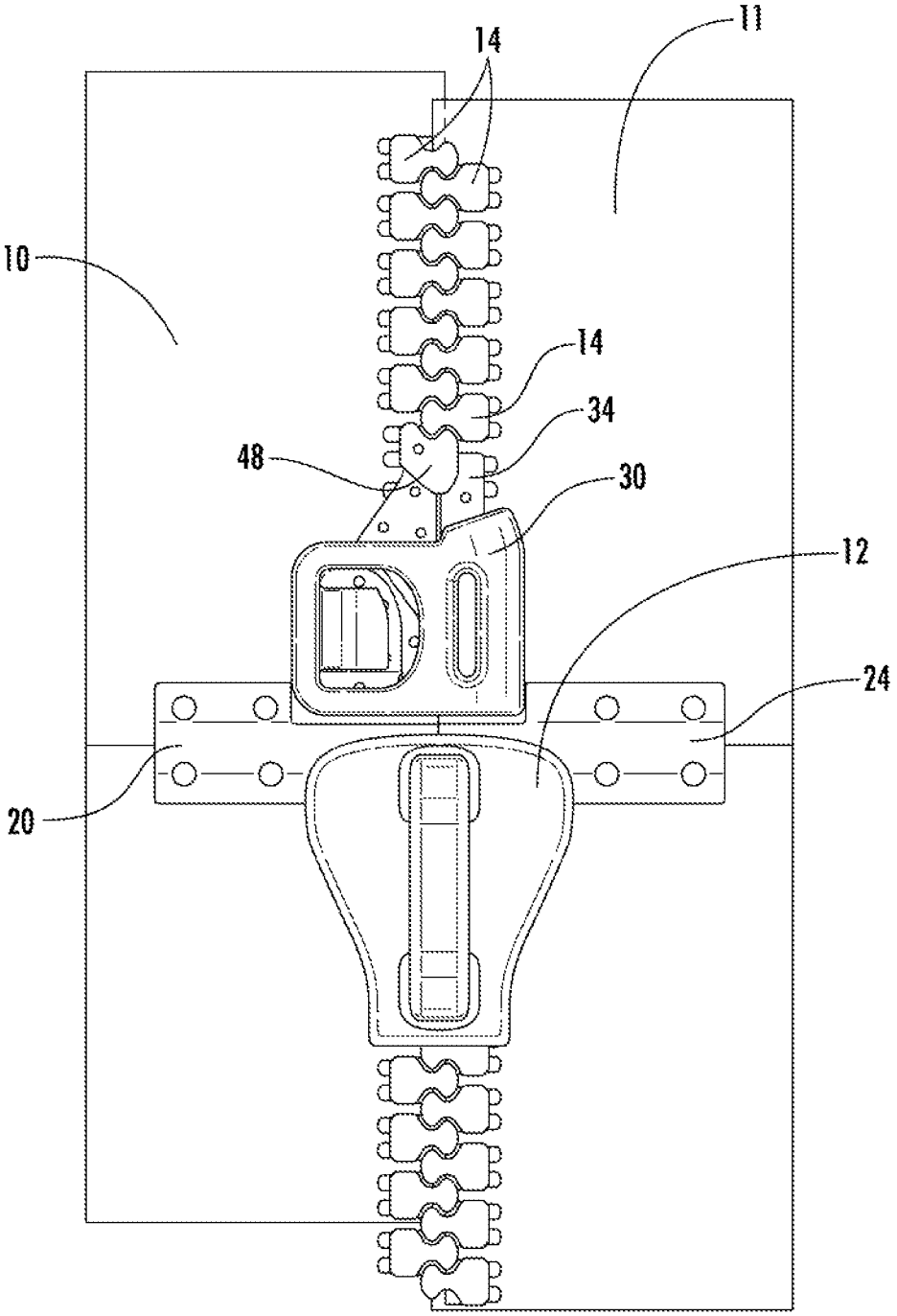
FIG. 7 is a front view of a portion of the slide fastener of FIG. 1, shown in the closed position.
Figure 15B:
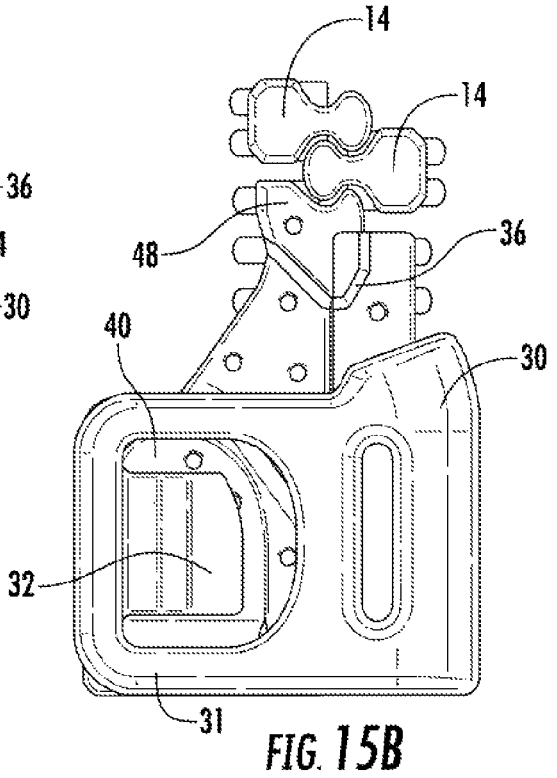
FIG. 15B illustrates the engagement of the pin element of FIG. 14 with the box element of FIG. 11, in isolation.
Figure 16:
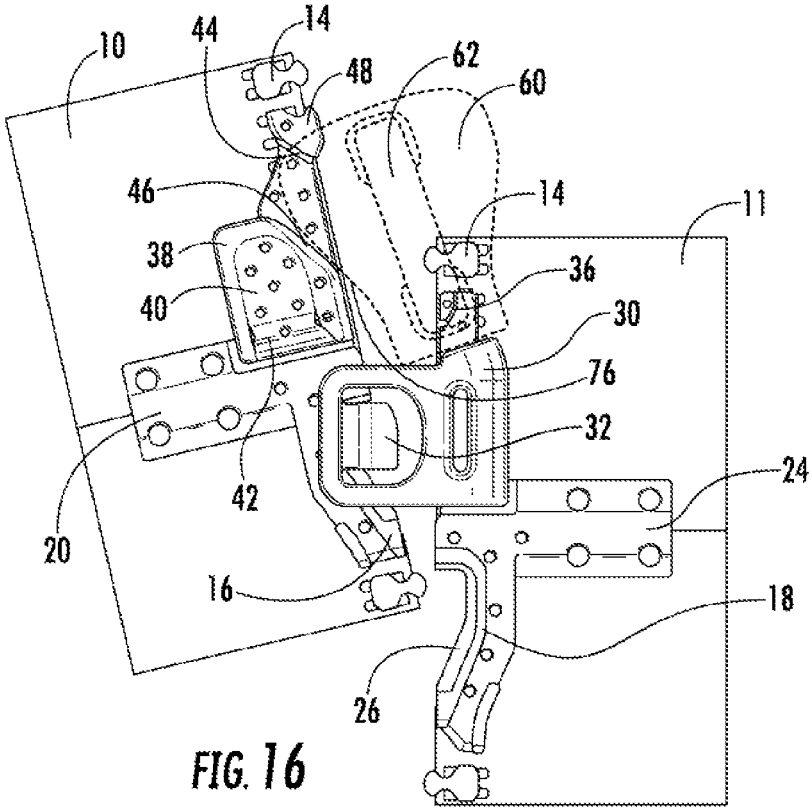
FIG. 16 illustrates the pin element of FIG. 14 with respect to the box element of FIG. 11, as the slider is aligned with the elements.

In operation, as shown in FIG. 16, slider 12 engages with pin 38 as pin 38 is inserted into box 30 from the side of the slider 12. Specifically, flanges 76 of slider 12 ride along edges 46 and edges 44 of pin 38. The angle and configuration of edges 44, 46 helps keep the elements 14 of tapes 10, 11 aligned correctly as the slider 12 engages the tapes 10, 11 and the pin 38 is inserted into box 30. Specifically, as shown in FIG. 15A, pin 38 is inserted into the cavity 33 of the box 30 into the initially engaged position such that protrusions 42 force apart the deformable arms 32 of the box 30 from an initial position into a flexed position. As the pin 38 moves from the initially engaged position (FIG. 15A) into the received position (FIG. 15B), the arms 32 move past protrusions 42 and each of the arms 32 snaps back toward its initial position and is received within one of the recessed insertion area 40 (FIG. 15B). When the arms 32 snap back toward their initial position, they produce a tactile response such as a clicking feeling and an audible snapping sound, indicating that the pin 38 is in the received position with the box 30 and a water and/or air tight seal has been created. In this way, the arms 32 function as an insertion span mechanism. FIGS. 7 and 17 illustrate the slide fastener assembly 8 after the pin 38 has been fully received in box 30 and is thus in the received position, a water and/or air tight seal has been formed, and slider 12 is properly positioned with respect to tapes 10, 11 so it may open or close the slide fastener 8.

Referring back to FIG. 14, a half element 48 extends from each portion 41 of the pin 38. Half element 48 is shaped and sized to be received within cavity 36 of guide element portion 34 of box 30 and to cooperate with the element 14 adjacent the guide element portion 34 (FIG. 7) when pin 38 is fully engaged with box 30 and is in the received position. Each of half elements 48 includes a first edge 44 and each portion 41 of the pin 38 includes a second edge 46. As shown in FIG. 16, edges 46 are dimensioned to engage with flanges 76 of the slider 12 (FIG. 2) to guide the slider 12 into proper position with respect to tapes 10, 11 when the pin 38 is inserted into box 30.

As shown in FIGS. 9-10, the edges 54, 56 of the tapes 10, 11 are exposed at the sides of the top stops 16, 18. As such, when the slider 12 interacts with the top stops 16, 18 of the tapes 10, 11, top stops 16, 18 compress the edges 54, 56 of the tapes 10, 11 to provide a watertight and/or airtight seal by press bonding. In particular, edges 27, 29 and edges 23, 25 of top stops 16, 18 (FIG. 17) compress against each other when slider 12 is received within cavity 28. The compression of top stops 16, 18 in turn supports the press bonding of the tape edges due to the compression of box 30 and the pin 38.

Figure 20:
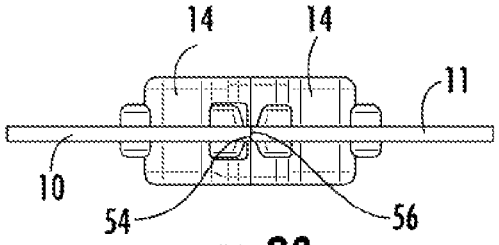
FIG. 20 is a cross-sectional view of the portion of the elements shown in FIG. 19, taken along the line A-A.

Similarly, as also shown in FIGS. 9-10, the edges 54, 56 of the tapes 10, 11 are exposed at the side of the box 30 and the side of the pin 38. As such, when pin 38 is in the received position with respect to the box 30, the pin 38 is compressed with respect to the box 30 by the arms 32. In turn, the edges 54, 56 of the tapes 10, 11 along the box 30 and the pin 38 are compressed, providing a water and/or air tight seal. As mentioned above, the compression of top stops 16, 18 when the slider 12 is received within the top stops 16, 18 also helps compress the tape edges 54, 56 adjacent the box 30 and the pin 38. Moreover, the engagement of the half elements 48 of the pin 38 with the first element 14 immediately above the guide element portion 34 of the box 30 (illustrated in FIG. 8) further compresses the tape edges 54, 56 and encourages the press bonding of the tape edges and the formation or a water and/or air tight seal. FIG. 20 is a cross-section illustrating the compression of both edges 54, 56 of tapes 10, 11 to form a water and/or air tight seal.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

The invention claimed is:

1. A slide fastener assembly comprising:

(a) a first tape comprising a top side, a bottom side, edges and a plurality of elements;

(b) a second tape comprising a top side, a bottom side, edges and a plurality of elements;

(c) a pin comprising a first portion on the top side of the first tape and a second portion on the bottom side of the first tape, each of the first and second portions comprising:

an outer surface;

an insertion area recessed relative to the outer surface;

a protrusion that projects from the insertion area, wherein a depth extends between the two protrusions;

(d) a box that is integral with the second tape and that comprises a first portion on the top side of the second tape and a second portion on the bottom side of the second tape, wherein a cavity separates an inner surface of the first portion from an inner surface of the second portion and wherein a first deformable arm projects from the first portion into the cavity and a second deformable arm projects from the second portion into the cavity;

wherein a distance between inner surfaces of the first and second deformable arms is less than the depth between the two protrusions.

2. The slide fastener assembly of claim 1, wherein the cavity of the box is configured to receive the pin such that the protrusions force apart the first and second deformable arms from an initial position into a flexed position when the pin is in an initially engaged position.

3. The slide fastener assembly of claim 2, wherein the first and second deformable arms are configured to audibly snap back from the flexed position toward the initial position as the pin moves from the initially engaged position into a received position, wherein the first and second deformable arms are seated within the insertion areas in the received position.

4. The slide fastener assembly of claim 1, wherein, when the pin is received within the box, the edges of the first and second tapes are compressed against one another to form a water and air tight seal.

5. The slide fastener assembly of claim 1, wherein each of the first and second portions of the pin further comprises a half element that is received within a respective cavity of a guide element portion of the box when the pin is received within the box.

6. The slide fastener assembly of claim 2, wherein each of the first and second portions of the pin further comprises at least one edge that is configured to guide flanges of a slider to align the slider with respect to the first and second tapes as the pin moves into the initially engaged position.

7. The slide fastener assembly of claim 1, further comprising a first top stop positioned on the first tape and a second top stop positioned on the second tape, wherein an edge of the first top stop compresses against an edge of the second top stop to facilitate creation of a water and air tight seal when a slider is received within a cavity formed by the first top stop and the second top stop.

8. The slide fastener assembly of claim 1, wherein:

ends of the first tape are attached together so that the first tape forms a loop;

ends of the second tape are attached together so that the second tape forms a loop; and the first tape and the second tape are separate from one another when the elements of the first and second tapes are unengaged such that the slide fastener assembly is an open-end slide fastener.

9. The slide fastener of claim 8, wherein the ends of the first tape and the ends of the second tape are secured together by injection molding.

10. An open-end slide fastener assembly comprising:

(a) a first tape comprising a top side, a bottom side, edges and a plurality of elements;

(b) a second tape comprising a top side, a bottom side, edges and a plurality of elements; wherein the first tape and the second tape are separate from one another when the elements of the first and second tapes are not engaged;

(c) a pin comprising at least one portion associated with the top side or the bottom side of the first tape, the at least one portion of the pin comprising;

an outer surface;

an insertion area recessed relative to the outer surface; and a protrusion that projects from the insertion area;

(d) a box associated with the second tape and comprising at least one portion that extends from the top side or the bottom side of the second tape, wherein a deformable arm projects from the at least one portion of the box into a cavity of the box, wherein:

the cavity of the box is configured to receive the pin in an initially engaged position such that the protrusion forces the deformable arm from an initial position into a flexed position;

the deformable arm is configured to audibly snap back from the flexed position toward the initial position as the pin moves from the initially engaged position into a received position, wherein the deformable arm is seated within the insertion area when the pin is in the received position; and when the pin is in the received position, the edges of the first and second tapes are compressed against one another to form a water and air tight seal.

11. The open-end slide fastener assembly of claim 10, wherein the deformable arm is made of a flexible material.

12. The open-end slide fastener assembly of claim 10, wherein the at least one portion of the pin further comprises a half element that is received within a cavity of a guide element portion of the box when the pin is in the received position and that enhances the water and air tight seal by further compressing together the edges of the first and second tapes.

13. The open-end slide fastener assembly of claim 10, wherein the at least one portion of the pin further comprises at least one edge that is configured to guide at least one flange of a slider to align the slider with respect to the first and second tapes as the pin moves into the initially engaged position.

14. The open-end slide fastener assembly of claim 10, further comprising a first top stop positioned on the first tape and a second top stop positioned on the second tape, wherein an edge of the first top stop compresses against an edge of the second top stop to enhance the water and air tight seal when a slider is received within a cavity formed by the first top stop and the second top stop.

15. The open-end slide fastener assembly of claim 10, wherein:

ends of the first tape are attached together so that the first tape forms a loop; and ends of the second tape are attached together so that the second tape forms a loop.

16. The open-end slide fastener assembly of claim 15, wherein the ends of the first tape and the ends of the second tape are secured together by injection molding.

17. An open-end slide fastener assembly comprising:

(a) a first tape comprising a top side, a bottom side, edges and a plurality of elements;

(b) a second tape comprising a top side, a bottom side, edges and a plurality of elements; wherein the first tape and the second tape are separate from one another when the elements of the first and second tapes are not engaged;

(c) a pin associated with the first tape; and (d) a box associated with the second tape, wherein the box is configured to receive the pin such that the edges of the first and second tapes are compressed against one another to form a water and air tight seal, wherein:

first and second ends of the first tape are attached together so that the first tape forms a loop; and first and second ends of the second tape are attached together so that the second tape forms a loop.

18. The open-end slide fastener assembly of claim 17, wherein:

the pin comprises a first portion associated with a top side of the first tape and a second portion associated with a bottom side of the first tape, wherein each of the first and second portions comprise:

an outer surface;

an insertion area recessed relative to the outer surface; and a protrusion that projects from the insertion area; and the box comprises a first portion that extends from the top side of the second tape and a second portion that extends from the bottom side of the second tape, wherein a cavity separates an inner surface of the first portion from an inner surface of the second portion and wherein a first deformable arm projects from the first portion into the cavity and a second deformable arm projects from the second portion into the cavity.

19. The open-end slide fastener assembly of claim 18, wherein:

the cavity of the box is configured to receive the pin in an initially engaged position such that each of the protrusions forces apart one of the first and second deformable arms from an initial position into a flexed position; and the first and second deformable arms are configured to audibly snap back from the flexed position toward the initial position as the pin moves from the initially engaged position into a received position, wherein the first and second deformable arms are each seated within one of the insertion areas when the pin is in the received position.

20. The open-end slide fastener assembly of claim 19, wherein each of the first and second portions of the pin further comprises a half element that is received within a respective cavity of a guide element portion of the box when the pin is in the received position and that enhances the water and air tight seal by further compressing together the edges of the first and second tapes.

21. The open-end slide fastener assembly of claim 19, wherein each of the first and second portions of the pin further comprises at least one edge that is configured to guide at least one flange of a slider to align the slider with respect to the first and second tapes as the pin moves into the initially engaged position.

22. The open-end slide fastener assembly of claim 17, wherein:

the pin is formed at the first end of the first tape and a first end stop is formed at the second end of the first tape;

the box is formed at the first end of the second tape and a second top stop is formed at the second end of the second tape;

the first end stop has a shape recessed in a right and left direction of the first tape;

the second end stop has a shape recessed in a right and left direction of the second tape; and when an edge of the first end stop abuts an edge of the second end stop, the first end stop and the second end stop form a cavity configured to receive a neck of a slider.

23. The open-end slide fastener assembly of claim 22, wherein:

a first extension joins the first end of the first tape and the second end of the first tape and extends laterally from the first end stop; and a second extension joins the first end of the second tape and the second end of the second tape and extends laterally from the second end stop.

24. An open-end slide fastener assembly comprising:

(a) a first tape comprising a top side, a bottom side, edges and a plurality of elements;

(b) a second tape comprising a top side, a bottom side, edges and a plurality of elements; wherein the first tape and the second tape are separate from one another when the elements of the first and second tapes are not engaged;

(c) a pin associated with the first tape; and (d) a box associated with the second tape, wherein the box is configured to receive the pin, wherein:

first and second ends of the first tape are attached together so that the first tape forms a loop;

first and second ends of the second tape are attached together so that the second tape forms a loop;

the pin is formed at the first end of the first tape and a first end stop is formed at the second end of the first tape;

the box is formed at the first end of the second tape and a second top stop is formed at the second end of the second tape;

the first end stop has a shape recessed in a right and left direction of the first tape;

the second end stop has a shape recessed in a right and left direction of the second tape; and when an edge of the first end stop abuts an edge of the second end stop, the first end stop and the second end stop form a cavity configured to receive a neck of a slider.

25. The open-end slide fastener assembly of claim 24, wherein:

a first extension joins the first end of the first tape and the second end of the first tape and extends laterally from the first end stop; and a second extension joins the first end of the second tape and the second end of the second tape and extends laterally from the second end stop.

* * * * *